US007380659B1

(12) United States Patent
Hooper

(10) Patent No.: US 7,380,659 B1
(45) **Date of Patent: *Jun. 3, 2008**

(54) TOOL CADDY

(76) Inventor: Leslie Hooper, 2000 E. Marlboro Ave., Apt. No. 102, Landover, MN (US) 20785

( * ) Notice: Subject to any disclaimer, the term of this patent is extended or adjusted under 35 U.S.C. 154(b) by 400 days.

This patent is subject to a terminal disclaimer.

(21) Appl. No.: 11/124,995

(22) Filed: May 9, 2005

Related U.S. Application Data

(63) Continuation-in-part of application No. 10/236,166, filed on Sep. 6, 2002, now Pat. No. 6,935,499.

(51) Int. Cl.
*B65D 85/28* (2006.01)

(52) U.S. Cl. ..... 206/373; 206/372

(58) Field of Classification Search ..... 206/372, 206/373, 216; D9/308; D3/201, 234, 270, D3/321, 323, 327, 905; 220/9.4, 213, 305, 220/676; 150/105, 106, 107, 110; 190/102
See application file for complete search history.

(56) References Cited

U.S. PATENT DOCUMENTS 4,673,081 A 6/1987 Habig et al.
5,002,401 A 3/1991 Blackman
5,267,662 A 12/1993 Hayes
5,285,900 A 2/1994 Swingler
D360,977 S 8/1995 Katz
5,489,042 A 2/1996 Ewald
5,527,409 A 6/1996 Lanphier
5,653,337 A 8/1997 Cirigliano
5,834,083 A 11/1998 Pignatro, Jr.
5,894,914 A 4/1999 Jubin
6,041,716 A 3/2000 Alibozek
6,126,003 A 10/2000 Brouard
6,454,121 B1 9/2002 Kurtz et al.
6,571,998 B2 6/2003 Godshaw et al.

*Primary Examiner*—J. Gregory Pickett
(74) *Attorney, Agent, or Firm*—Jeffrey A. Proehl; Woods Fuller Shultz & Smith PC

(57) ABSTRACT

A tool caddy for providing a tool carrier that is rugged and holds a large number of tools. The tool caddy includes a main tool storage unit having an upper opening into an interior and comprising a core section having a pair of side walls and a bottom wall extending between the side walls. A filler wall is mounted over the side wall opening of the core section with each of the filler walls being substantially coplanar with one of the side walls. A strap is mounted on the storage unit for suspending the storage unit from a user's body.

19 Claims, 4 Drawing Sheets

TOOL CADDY

CROSS REFERENCE TO RELATED APPLICATION

This application is a continuation-in-part of U.S. patent application Ser. No. 10/236,166, filed Sep. 6, 2002, now U.S. Pat. No. 6,935,499, issued Aug. 30, 2005.

BACKGROUND OF THE INVENTION

1. Field of the Invention

The present invention relates to tool containers and more particularly pertains to a new tool caddy for providing a tool carrier that is rugged and holds a large number of tools.

2. Description of the Prior Art

The use of tool containers is known in the prior art. More specifically, tool containers heretofore devised and utilized are known to consist basically of familiar, expected and obvious structural configurations, notwithstanding the myriad of designs encompassed by the crowded prior art which have been developed for the fulfillment of countless objectives and requirements.

In particular, the known tool containers are formed of rigid materials such as metal or stiff plastic, and are specially formed for the purpose of holding tools.

In these respects, the tool caddy according to the present invention substantially departs from the conventional concepts and designs of the prior art, and in so doing provides an apparatus primarily developed for the purpose of providing a tool carrier that is rugged and holds a large number of tools.

SUMMARY OF THE INVENTION

In view of the foregoing disadvantages inherent in the known types of tool containers now present in the prior art, the present invention provides a new tool caddy construction wherein the same can be utilized for providing a tool carrier that is rugged and holds a large number of tools.

To attain this, the present invention generally comprises a main tool storage unit having an upper opening into an interior and comprising a core section having a pair of side walls and a bottom wall extending between the side walls. A filler wall is mounted over the side wall opening of the core section with each of the filler walls being substantially coplanar with one of the side walls. A strap is mounted on the storage unit for suspending the storage unit from a user's body.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

One significant advantage of the present invention is the ability to form the tool caddy from inexpensive materials such as used vehicle tires. The tool caddy of the invention thus formed is relatively soft and flexible but retains sufficient structural rigidity to hold tools, and is thus easier to carry close to the body of the user without injuring the user's body.

Further advantages of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects of the invention will become apparent when consideration is given to the following detailed description thereof. Such description makes reference to the annexed drawings wherein.

DESCRIPTION OF PREFERRED EMBODIMENTS

Figure 1:
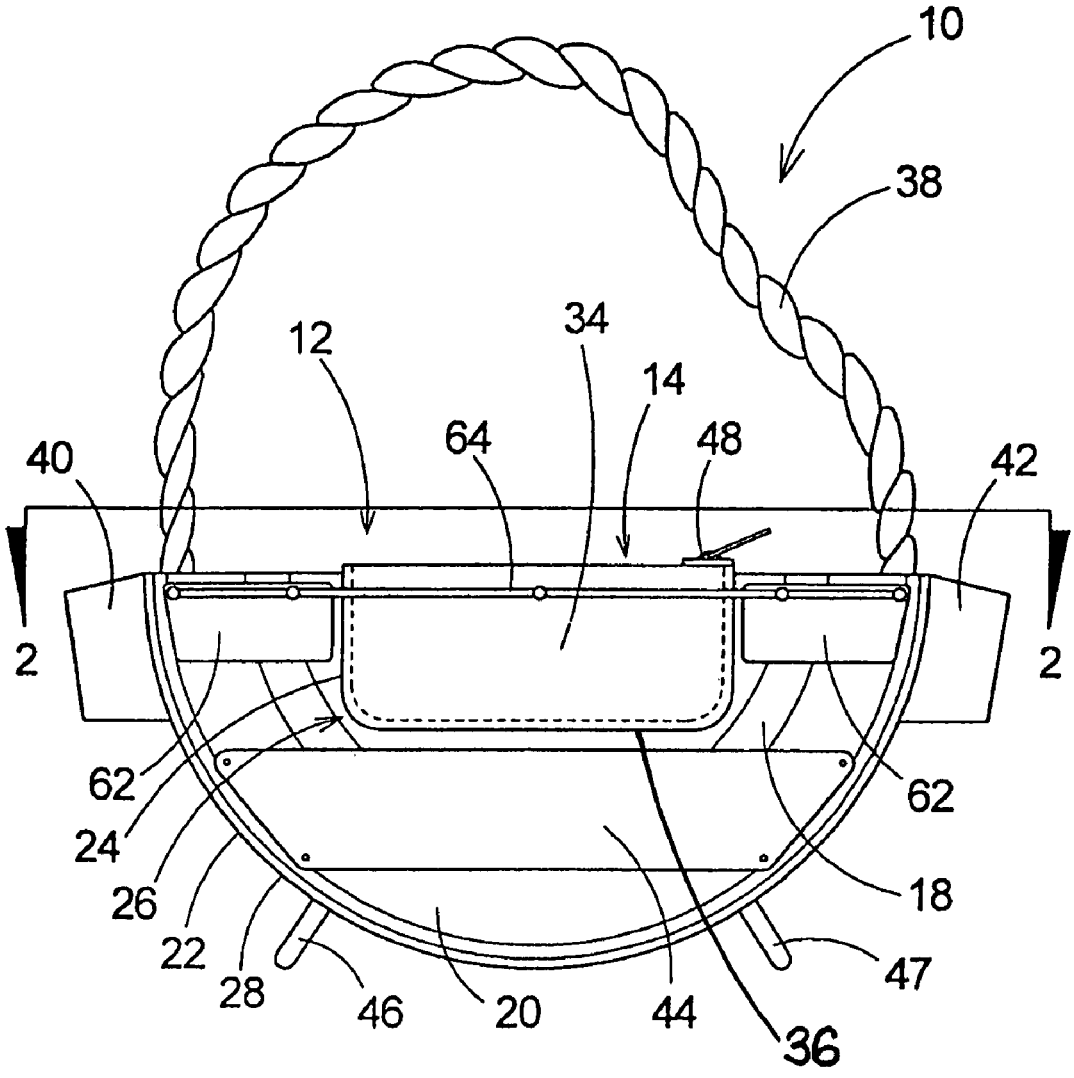
FIG. 1 is a schematic front view of a new tool caddy according to the present invention.
Figure 2:
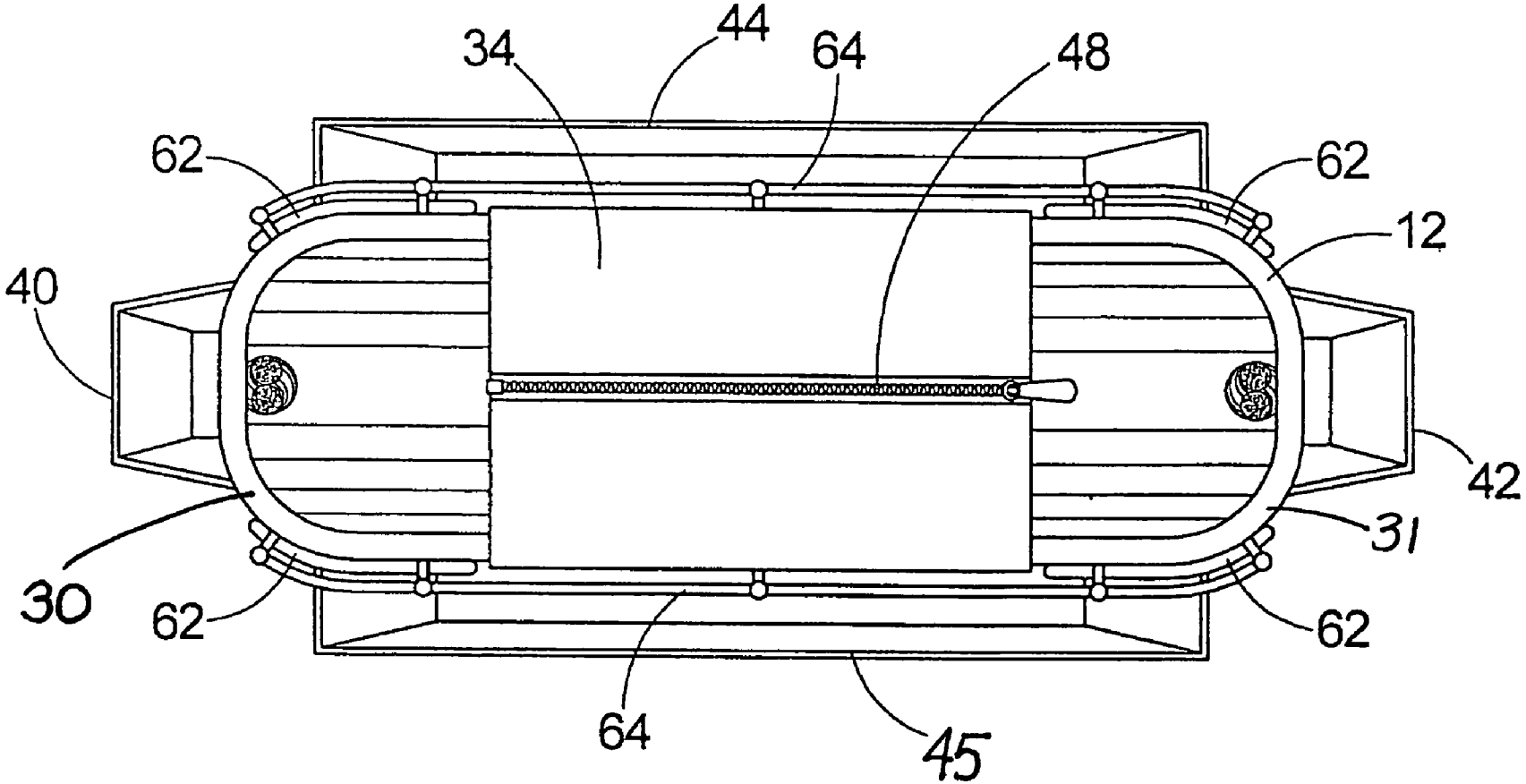
FIG. 2 is a schematic rear view of the present invention.
Figure 3:
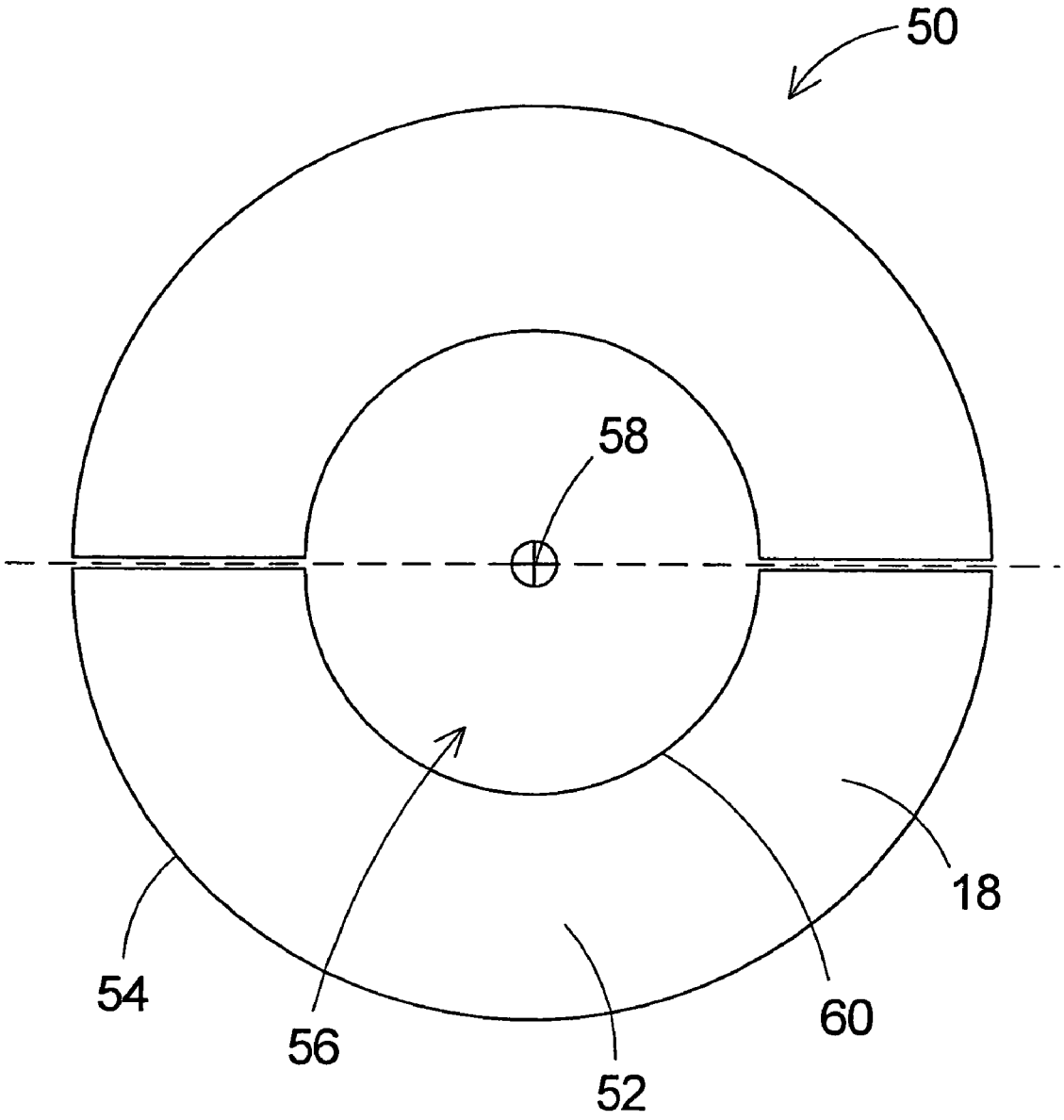
FIG. 3 is a schematic top view of a tire cut in a manner suitable for forming the tool caddy of the present invention.
Figure 4:
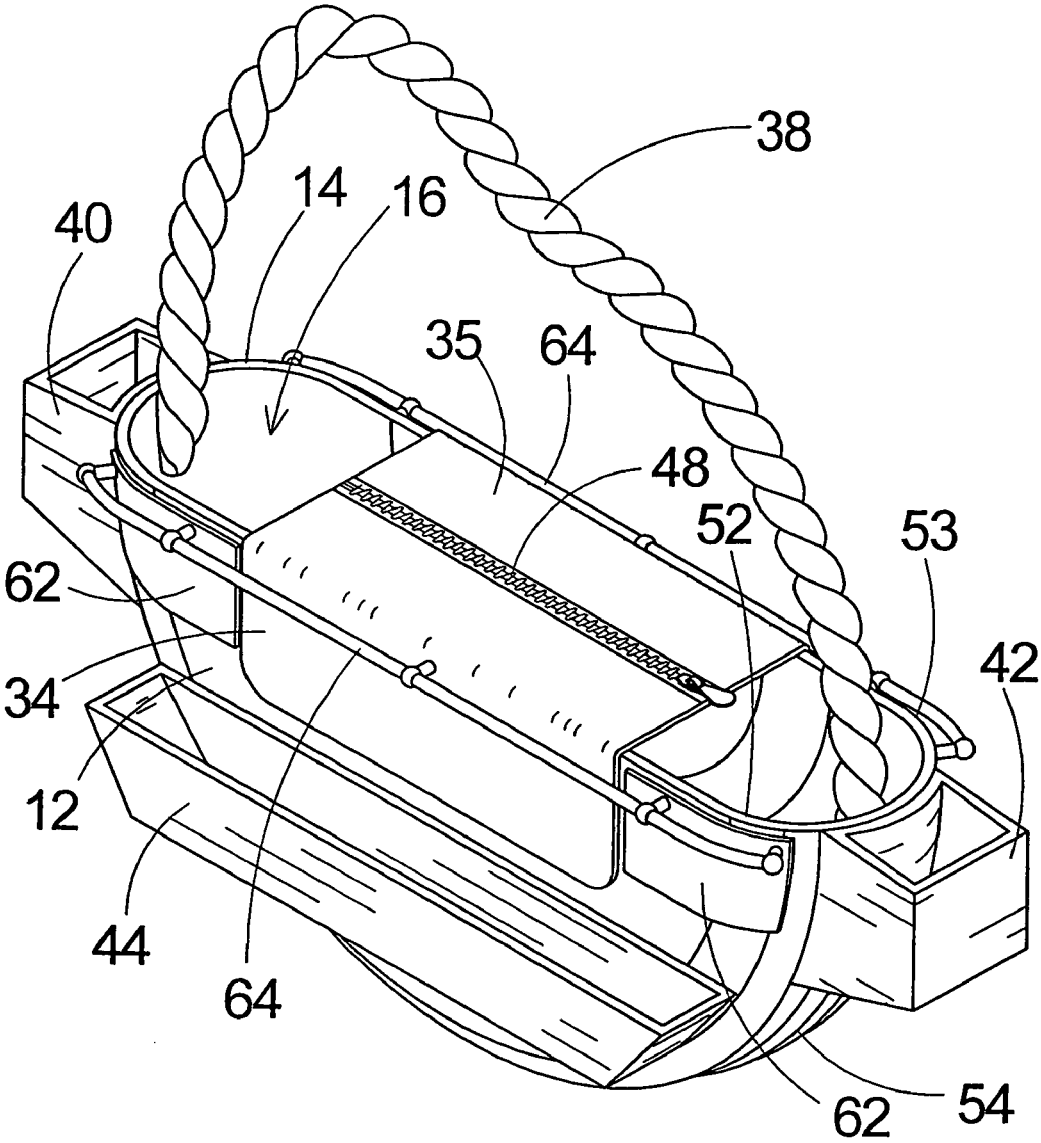
FIG. 4 is a schematic perspective view of the present invention.

With reference now to the drawings, and in particular to FIGS. 1 through 4 thereof, a new tool caddy embodying the principles and concepts of the present invention and generally designated by the reference numeral 10 will be described.

As best illustrated in FIGS. 1 through 4, the tool caddy 10 generally comprises a main tool storage unit 12 for carrying tools. The main tool storage unit 12 has an upper opening 14 that opens into an interior 16 of the main tool storage unit, and tools and other items may be passed through the upper opening for placing them in, and retrieving them from, the interior of the main tool storage unit.

The main tool storage unit 12 may include a core section 18 having a pair of side walls 20, 21 and a bottom wall 22 that extends between the side walls 20, 21. A portion of the upper opening 14 may be defined by the side 20, 21 and the bottom 22 walls. The side walls 20, 21 may each have an inner perimeter edge 24, 25 that defines a side wall opening 26, 27 in each of the side walls. The side walls 20, 21 may each have an outer perimeter edge 28, 29 mounted on the bottom wall 22. The bottom wall 22 may have a pair of opposite end edges 30, 31, and the bottom wall 22 may have an arcuate shape between the opposite end edges 30, 31 such that an upper surface 32 of the bottom wall 22 is substantially concave upwards toward the interior 16 of the main tool storage unit 12.

The main tool storage unit may also include a filler wall 34, 35 mounted over each of the side wall openings 26, 27 of the core section 18. Each of the filler walls 34, 35 may have an upper edge 36, 37 that may be substantially coplanar with the end edges 30, 31 of the core section 18. Each of the filler walls 34, 35 may be substantially semicircular in perimeter shape. A portion of the perimeter edge 36 of each of the filler walls 34, 35 may be mounted to a portion of the inner perimeter edge 24, 25 of the side wall 20, 21.

A strap 38 may be mounted on the main tool storage unit 12 for supporting and suspending the main tool storage unit from a body of a user, and the most preferred straps are elongate and flexible. In one embodiment of the invention, the strap 38 is formed from a length of rope.

A first pouch 40 may be mounted on the main tool storage unit 12 for holding an object such as a tape measure. The first pouch 40 may be located on the bottom wall 22 of the core section, and may be positioned adjacent to a first one 30 of the end edges of the core section 18. A second pouch 42 may be mounted on the main tool storage unit 12 for holding miscellaneous items such as tools. The second pouch 42 may be located on the bottom wall 22 of the core section 18, and may be positioned adjacent to a second one 31 of the end edges of the core section. A first holder 44 may be mounted on the main tool storage unit 12 for holding a relatively elongate tool such as a hacksaw. The holder 44 may be located on one of the filler walls 34, 35 of the main tool storage unit 12. The holder 44 may be positioned adjacent to a lower edge of the filler wall 34, 35. A second holder 45 may be mounted on the opposite filler wall from the first holder 44, and may be suitable for receiving and holding a hammer.

Optionally, a pair of feet 46, 47 may be mounted on the main tool storage unit 12, and may be located on an outer surface 48 of the bottom wall. One foot 46 of the pair of feet may be positioned between a central location on the bottom wall and a first one 30 of the end edges, and a second foot 47 of the pair of feet may be positioned between the central location on the bottom wall and a second one 31 of the end edges.

A closure 48 may be provided for selectively closing a gap between the upper edges 36, 37 of the filler walls 34, 35 of the main tool storage unit 12, and thereby close the upper opening into the interior. The closure 48 selectively joins the upper edges 36, 37 of the filler walls together, and in one embodiment of the invention comprises a zipper.

One aspect of the invention contemplates a method of forming the tool caddy system 10 which is especially useful for forming the main tool storage unit tool in an easy and inexpensive manner, and permits the beneficial use of used vehicle tires that can prolong the usefulness of the tires after their use on a vehicle is no longer feasible. In the method, a tire 50 is provided that has a pair of side walls 52, 53 and a perimeter tread wall 54 that extends between the side walls. Each of the side walls 52, 53 defines a side wall opening 56, and the tire has an axis of rotation 58 that is surrounded by the side wall opening 56. The side wall opening 56 is defined by an inner perimeter edge 60 on the side wall 52, 53.

The main tool storage unit 12 may be formed from the tire by cutting the side 52, 53 and perimeter tread 54 walls of the tire 50 at two locations on the tire to form the core section 18 with portions of the side walls 52, 53 of the tire forming the side walls 20, 21 of the core section and a portion of the perimeter tread wall 54 of the tire forming the bottom wall 22 of the core section. In one embodiment of the invention, the tire may be severed in a plane that extend through the axis of rotation of the tire such that the core section includes a semicircular section of the tire, with the opposite end edges of the side and perimeter tread walls lying in the plane and a portion of the side wall opening being positioned on each side of the plane. Optionally, the tire may be cut at locations that are less than 180 degrees away from each other, although the capacity of the interior will be compromised.

A filler wall 34 may be mounted over the portion of the side wall opening on the core section, and the upper edge of the filler wall may extend substantially coplanar with the end edges of the core section. A perimeter edge of each of the filler walls may be mounted to a portion of the inner perimeter edge of the side wall in a suitable manner, such as by chemical bonding with an adhesive, or by mechanical connection such as, for example, sewing or tacking or stapling.

Additionally, the main tool storage unit 12 may comprise a plurality of reinforcement members 62 coupled to the side walls 20,21 of the core section 18. The reinforcement members 62 reinforce the side walls 20,21 to inhibit inadvertent bending of the side walls 20,21 when tools are positioned in the interior 16 of the main tool storage unit 12. The reinforcement members 62 are positioned adjacent an upper edge of the side walls 20,21 of the core section 18. Each of the reinforcement members 62 may comprise a plate formed of a relatively rigid material such as, for example, metal.

Additionally, the main tool storage unit 12 may comprise a plurality of reinforcement bars 64 coupled to the side walls 20,21 of the core section 18 and the filler wall 34,35. The reinforcement bars 64 may extend over each of the side wall openings of the core section 18. The reinforcement bars 64 help maintain the shape of the side walls 20,21 and the filler wall 34,35 when tools are positioned in the interior 16 of the main tool storage area. Each of the reinforcement bars 64 may comprise a bar formed of a relatively rigid material, such as, for example, metal.

As desired, a strap, a first pouch, a second pouch, a first holder, a second holder, a pair of feet, and a closure means may be mounted on the main tool storage unit.

In use, the user may easily place relatively larger tools in the interior of the main tool storage unit, and relatively smaller tools, or tools for which quick access is desired, may be located in the various pouches and holders on the exterior of the main tool storage unit.

With respect to the above description then, it is to be realized that the optimum dimensional relationships for the parts of the invention, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tool caddy system for carrying tools, comprising:

a main tool storage unit for carrying tools, the main tool storage unit having an upper opening into an interior of the main tool storage unit, the main tool storage unit comprising:

a core section having a pair of side walls and a bottom wall extending between the side walls, the side walls each having an inner perimeter edge defining a side wall opening, a portion of the upper opening being defined by the side and bottom walls; and a filler wall mounted over each of the side wall openings of the core section; and a strap mounted on the main tool storage unit for supporting and suspending the main tool storage unit from a body of a user;

wherein the main tool storage unit includes at least one reinforcement bar coupled to and extending between substantially opposite locations on one of the side walls of the core section to maintain the spacing of the opposite locations of the side wall across the side wall opening when tools are positioned in the interior of the main tool storage area.

2. The system of claim 1 wherein the core section of the main tool storage unit comprises a section of a tire.

3. The system of claim 1 wherein the main tool storage unit includes a pair of reinforcement bars, each reinforcement bar being coupled to and extending between substantially opposite locations on one of the side walls of the core section to maintain the spacing of the opposite locations of the side wall across the side wall opening when tools are positioned in the interior of the main tool storage area.

4. The system of claim 1 wherein the bottom wall is arcuate between the opposite end edges such that an upper surface of the bottom wall is concave upwards toward the interior of the main tool storage unit.

5. The system of claim 1 wherein the at least one reinforcement bar extends over one of the side wall openings of the core section.

6. The system of claim 1 wherein the at least one reinforcement bar extends across the filler wall.

7. The system of claim 1 wherein the main tool storage unit comprises a plurality of reinforcement members being coupled to the opposite locations on one of the side walls of the core section, the at least one reinforcement bar being mounted on the plurality of reinforcement members.

8. The system of claim 7, wherein the reinforcement members are positioned adjacent to an upper edge of the side walls of the core section.

9. The system of claim 1 additionally comprising a first pouch mounted on the main tool storage unit for holding a tape measure.

10. The system of claim 9 wherein the first pouch is located on the bottom wall of the core section adjacent to a first one of the end edges of the core section.

11. The system of claim 9 additionally comprising a second pouch mounted on the main tool storage unit for holding miscellaneous items.

12. The system of claim 11 wherein the second pouch is located on the bottom wall of the core section adjacent to a second one of the end edges of the core section.

13. The system of claim 12 additionally comprising at least one holder mounted on the main tool storage unit for holding a hacksaw, the at least one holder being located on one of the filler walls of the main tool storage unit.

14. The system of claim 13 wherein the at least one holder is positioned adjacent to a lower edge of the filler wall.

15. The system of claim 1 additionally comprising a pair of feet mounted on the main tool storage unit and located on an outer surface of the bottom wall.

16. The system of claim 1 additionally comprising a closure means for selectively closing a gap between the upper edges of the filler walls of the main tool storage unit.

17. The system of claim 16 wherein the closure means comprises a zipper.

18. A tool caddy system for carrying tools, comprising:

a main tool storage unit for carrying tools, the main tool storage unit having an upper opening into an interior of the main tool storage unit, the main tool storage unit comprising:

a core section having a pair of side walls and a bottom wall extending between the side walls, the side walls each having an inner perimeter edge defining a side wall opening, a portion of the upper opening being defined by the side and bottom walls; and a filler wall mounted over each of the side wall openings of the core section; and a strap mounted on the main tool storage unit for supporting and suspending the main tool storage unit from a body of a user;

wherein the main tool storage unit comprises a plurality of reinforcement bars being coupled to the side walls of the core section and the filler wall, the reinforcement bars extending over each of the side wall openings of the core section, the reinforcement bars maintaining the shape of the side walls and the filler wall when tools are positioned in the interior of the main tool storage area.

19. A tool caddy system for carrying tools, comprising:

a main tool storage unit for carrying tools, the main tool storage unit having an upper opening into an interior of the main tool storage unit, the main tool storage unit comprising:

a core section having a pair of side walls and a bottom wall extending between the side walls, a portion of the upper opening being defined by the side and bottom walls, wherein the side walls each have an inner perimeter edge defining a side wall opening, the side walls each have an outer perimeter edge mounted on the bottom wall;

wherein the bottom wall having a pair of opposite end edges, the bottom wall being arcuate between the opposite end edges such that an upper surface of the bottom wall is concave upwards toward the interior of the main tool storage unit;

wherein the core section comprises a section of a tire;

a filler wall mounted over each of the side wall openings of the core section, an upper edge of the filler wall being substantially coplanar with the end edges of the core section, each of the filler walls being substantially semicircular, a perimeter edge of each of the filler walls being mounted to a portion of the inner perimeter edge of the side wall;

a plurality of reinforcement members being coupled to the side walls of the core section, the reinforcement members reinforcing the side wall to inhibit inadvertent bending of the side walls when tools are positioned in the interior of the main tool storage unit, the reinforcement members are positioned adjacent an upper edge of the sidewall of the core section, each of the reinforcement members comprise a plate extending along a portion of the associated one of the side walls;

a plurality of reinforcement bars being coupled to the side walls of the core section and the filler wall, the reinforcement bars extending over each of the side wall openings of the core section, the reinforcement bars maintaining the shape of the side walls and the filler wall when tools are positioned in the interior of the main tool storage area a strap mounted on the main tool storage unit for supporting and suspending the main tool storage unit from a body of a user, the strap being formed of a length of rope;

a first pouch mounted on the main tool storage unit for holding a tape measure, the first pouch being located on the bottom wall of the core section, the first pouch being positioned adjacent to a first one of the end edges of the core section;

a second pouch mounted on the main tool storage unit for holding miscellaneous items, the second pouch being located on the bottom wall of the core section, the second pouch positioned adjacent to a second one of the end edges of the core section;

at least one holder mounted on the main tool storage unit for holding a hacksaw, the at least one holder being located on one of the filler walls of the main tool storage unit, the at least one holder being positioned adjacent to a lower edge of the filler wall;

a pair of feet mounted on the main tool storage unit, the pair of feet being located on an outer surface of the bottom wall, one foot of the pair of feet being positioned between a central location on the bottom wall between the end edges and a first one of the end edges and a second foot of the pair of feet being positioned between the central location on the bottom wall and a second one of the end edges; and a closure means for selectively closing a gap between the upper edges of the filler walls of the main tool storage unit, the closure means selectively joining the upper edges of the filler walls, the closure means comprising a zipper.

* * * * *